US007987649B1

(12) United States Patent
Polston

(10) Patent No.: US 7,987,649 B1
(45) Date of Patent: Aug. 2, 2011

(54) VENT STRIP FOR INSTALLATION WITH SOFFIT BOARDS OF DIFFERENT THICKNESSES

(75) Inventor: Scott Ross Polston, Houston, TX (US)

(73) Assignee: Ross Manufacturing, LLC, New Braunfels, TX (US)

( * ) Notice: Subject to any disclaimer, the term of this patent is extended or adjusted under 35 U.S.C. 154(b) by 217 days.

(21) Appl. No.: 12/350,633

(22) Filed: Jan. 8, 2009

Related U.S. Application Data

(60) Provisional application No. 61/025,397, filed on Feb. 1, 2008.

(51) Int. Cl.
*F24F 7/02* (2006.01)
*E04B 1/00* (2006.01)

(52) U.S. Cl. ..... 52/742.12; 52/95; 52/302.3; 454/260

(58) Field of Classification Search ..... 52/94, 95, 52/96, 302.1, 302.3, 742.12; 454/260, 364–366, 454/289–310, 270–271, 277–283, 245–248, 454/154–156
See application file for complete search history.

(56) References Cited

U.S. PATENT DOCUMENTS

| | | | | |
|---|---|---|---|---|
| 3,125,942 | A * | 3/1964 | Smith | 454/260 |
| 4,461,128 | A | 7/1984 | Knoebl | |
| 4,580,374 | A | 4/1986 | Quinnell | |
| 5,195,283 | A | 3/1993 | MacLeod et al. | |
| 5,243,793 | A | 9/1993 | MacLeod et al. | |
| 5,718,086 | A * | 2/1998 | Dunn | 52/95 |
| 5,799,446 | A * | 9/1998 | Tamlyn | 52/94 |
| 5,937,592 | A * | 8/1999 | Tamlyn | 52/95 |
| 6,705,052 | B1 * | 3/2004 | Larson | 52/95 |
| 6,718,699 | B1 * | 4/2004 | Larson | 52/95 |
| 6,955,010 | B2 | 10/2005 | Martin | |
| 7,484,335 | B1 * | 2/2009 | Dunlap | 52/95 |
| 2006/0240762 | A1 * | 10/2006 | Railkar et al. | 454/260 |

FOREIGN PATENT DOCUMENTS

| | | | |
|---|---|---|---|
| GB | 2126266 | A * | 3/1984 |
| GB | 2216648 | A * | 10/1989 |
| GB | 2268760 | A * | 1/1994 |
| GB | 2277372 | A * | 10/1994 |

OTHER PUBLICATIONS

Author; Unknown; Lomanco 105 Soffit Vent Installation Instructions (For Existing Construction); Date: Unknown.

* cited by examiner

*Primary Examiner* — Robert Canfield
*Assistant Examiner* — Jessie Fonseca
(74) *Attorney, Agent, or Firm* — Eric Karich

(57) ABSTRACT

A vent strip has a generally rectangular vent strip body having a width that is greater than an aperture width of an aperture through a soffit board. A plurality of apertures through the vent strip enabling air circulation. A pair of resilient board engaging elements extend upwardly and outwardly from the vent strip body for engaging the aperture. A plurality of board engaging notches or fingers, of each of the resilient board engaging elements, are adapted for engaging the soffit board regardless of the thickness of the soffit board.

1 Claim, 6 Drawing Sheets

VENT STRIP FOR INSTALLATION WITH SOFFIT BOARDS OF DIFFERENT THICKNESSES

CROSS-REFERENCE TO RELATED APPLICATIONS

This application for a utility patent claims the benefit of U.S. Provisional Application No. 61/025,397, filed Feb. 1, 2008.

STATEMENT REGARDING FEDERALLY SPONSORED RESEARCH

Not Applicable

BACKGROUND OF THE INVENTION

1. Field of the Invention

This invention relates generally to ventilation strips used in residential housing construction, and more particularly to a ventilation strip for installation in a soffit board installed under the eaves of a home.

2. Description of Related Art

Ventilation strips have been used in the prior art to close the space within or between soffit boards. The state of the art is Tamlyn, U.S. Pat. No. 5,799,446 and U.S. Pat. No. 5,881,502, which teach ventilation strips that are adapted to be positioned between a pair of soffit boards in the construction of residential housing. The ventilation strips include a vent with perforations, and two U-shaped channels for receiving the edges of the soffit boards. During installation, the vent is temporarily flexed or "bowed" to enable the edges of the soffit boards to be inserted into the U-shaped channels. The perforations through the vent allow air ventilation through the soffit boards. The above-described references are hereby incorporated by reference in full.

There are disadvantages, however, to the prior art ventilation strips that rely on bowing the ventilation strip to engage the U-shaped channels with the soffit boards. The required step of bowing the ventilation strip makes this style of ventilation strip difficult to install. It also suffers from lack of adaptability, with each U-channel only being able to engage a soffit board of a single thickness. This makes it necessary for retailers to carry a large inventory of ventilation strips, a different model of the ventilation strips for each thickness of soffit board commonly used.

The prior art does not teach a ventilation strip that includes a pair of board engaging elements that each include board engaging notches or fingers that may engage edges of different soffit boards of a plurality of thicknesses. The board engaging elements may also be installed without requiring the bowing of the ventilation strip. The present invention fulfills these needs and provides further related advantages as described in the following summary.

SUMMARY OF THE INVENTION

The present invention teaches certain benefits in construction and use which give rise to the objectives described below.

The present invention provides a vent strip and method for installing the vent strip in an aperture of a soffit board. The aperture is defined by an inside edge and an outside edge separated by an aperture width. The vent strip has a generally rectangular vent strip body having a width that is greater than the aperture width; a plurality of apertures through the vent strip for enabling air circulation through the vent strip; a pair of resilient board engaging elements extending upwardly and outwardly from the vent strip body; and a plurality of board engaging notches or fingers, of each of the resilient board engaging elements, that are adapted for engaging the soffit board. The board engaging notches or fingers may accommodate a soffit boards having a plurality of thicknesses. The resilient board engaging elements flex between a flexed position wherein the resilient board engaging elements may be inserted through the aperture of the soffit board, and a locked position wherein the resilient board engaging elements releasably engage the inside and outside edges of the aperture of the soffit board such that the vent strip body is held in a position to cover the aperture of the soffit board.

A primary objective of the present invention is to provide a vent strip having advantages not taught by the prior art.

Another objective is to provide a vent strip having a pair of resilient board engaging elements that flex inwardly to fit through an aperture in a soffit board, so that the vent strip may be installed on the soffit board without flexing or bowing the body of the vent strip.

A further objective is to provide a vent strip that includes a plurality of board engaging notches or fingers, on each of a pair of resilient board engaging elements, that are adapted for engaging soffit boards having a plurality of thicknesses.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
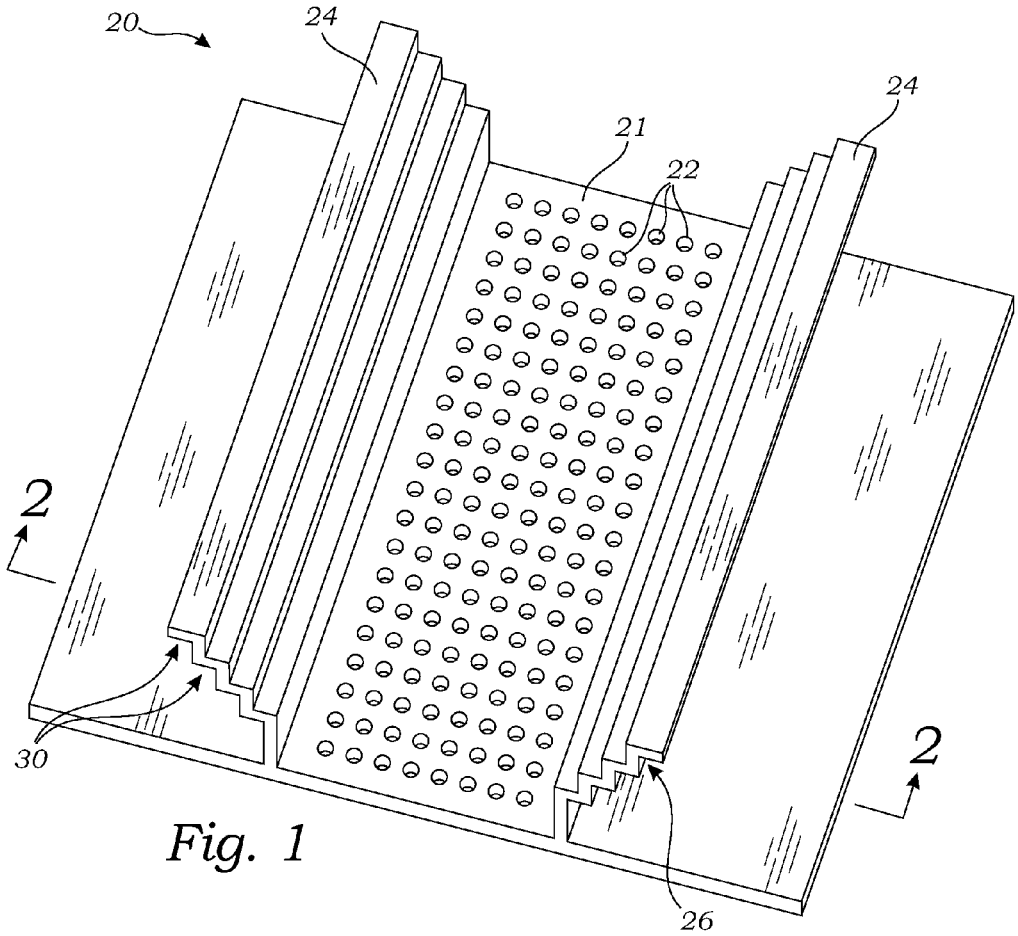
FIG. 1 is a perspective view of a vent strip according to one embodiment of the present invention.

The above-described drawing figures illustrate the invention, a soffit assembly 10 adapted for installation under an eave 57 of a roof 58 on a building 54. The soffit assembly 10 includes a vent strip 20 that is adapted to be installed in an aperture 14 of a soffit board 12. The vent strip 20 may accommodate soffit boards 12 having a plurality of thicknesses. This construction allows retailers to carry a much smaller inventory of vent strips 20, because the vent strip 20 of the present invention can fit a wide variety of soffit boards, while prior art vent strips are adapted to fit a soffit board of a particular thickness.

Figure 2:
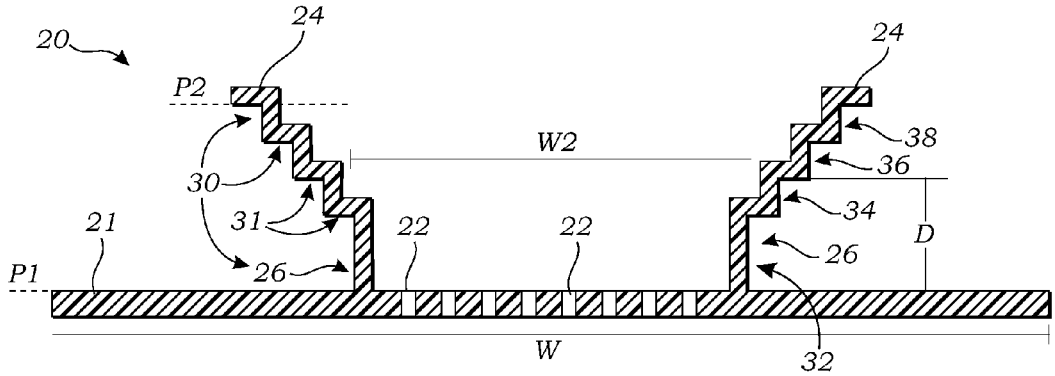
FIG. 2 is a sectional view thereof taken along line 2-2 in FIG. 1.
Figure 13:
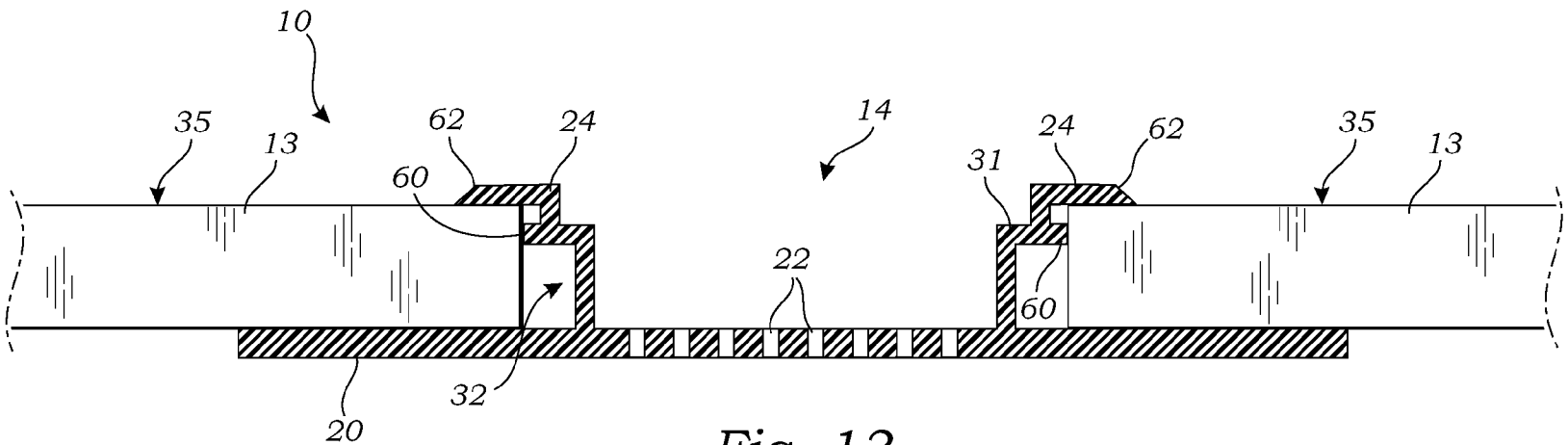
FIG. 13 is a sectional view thereof, illustrating the vent strip may be installed on a soffit board of a greater thickness.

FIG. 1 is a perspective view of a vent strip 20 according to one embodiment of the present invention, and FIG. 2 is a front elevational view thereof. As shown in FIG. 1, the vent strip 20 includes a vent strip body 21 that includes a plurality of apertures 22 for enabling air circulation through the vent strip 20. The vent strip 20 is adapted to be installed in an aperture 14 in the soffit board 12, as shown in FIGS. 3-6, under the eave 57 of the roof 58*m* as illustrated in FIG. 13.

As illustrated in FIGS. 1 and 2, the vent strip body 21 may be a generally planar construction that may be of generally rectangular shape. For purposes of this application, the term "rectangular" is defined to include any particular shape or form that is elongate and generally shaped to close the aperture in the soffit board 12, which may vary if desired by one skilled in the art. The vent strip body 21 may be constructed of any suitably strong and durable material (e.g., plastic) and may be relatively rigid, as it does not have to bend or flex as is required by prior art strips, although great rigidity is not necessarily required either.

In the embodiment of FIGS. 1 and 2, the vent strip 20 has a width W and includes a pair of resilient board engaging elements 24 that extend upwardly and outwardly from the vent strip body 21 for engaging the soffit board 12, as described below. The pair of board engaging elements 24 are spaced apart by a second width W2, which is discussed in greater detail below.

Figure 6:
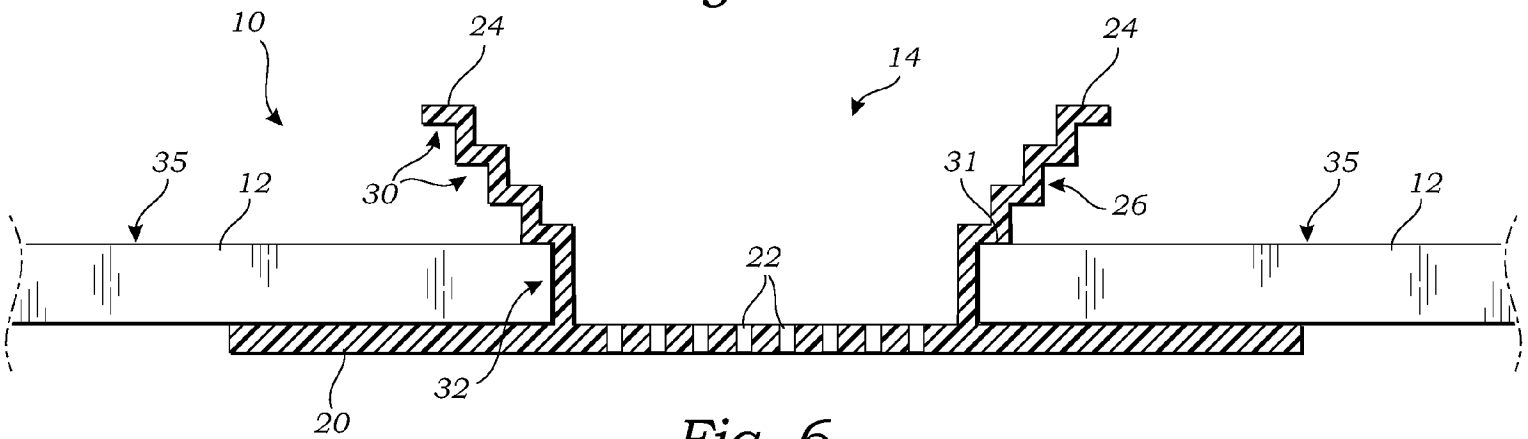
FIG. 6 is a sectional view of the soffit assembly, illustrating the vent strip once it has been installed in a soffit board of a lesser thickness.
Figure 7:
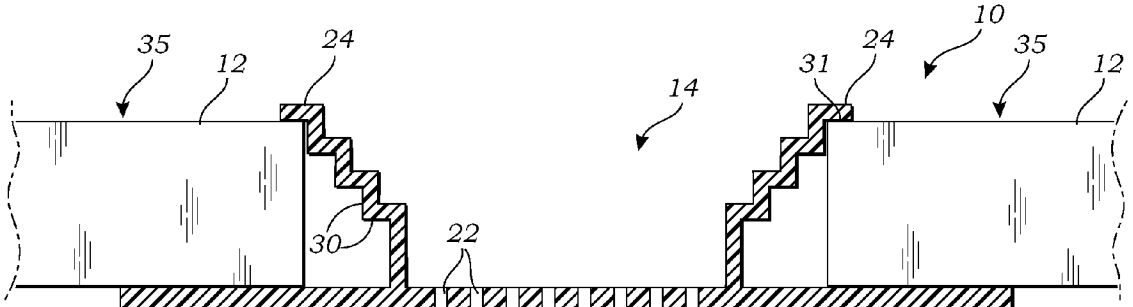
FIG. 7 is a sectional view of the soffit assembly, illustrating the vent strip as installed on a soffit board of a greater thickness.

The resilient board engaging elements 24 each have an outer structure and/or surface 26 adapted for engaging the soffit board 12 (shown in FIGS. 3-6, and discussed further below). In alternative embodiments, the vent strip 20 may include only one resilient board engaging element 24, as shown in FIGS. 6 and 7, and as described below, as long as the vent strip 20 may be inserted without bending or flexing the vent strip body 21.

As shown in FIGS. 1 and 2, the surfaces 26 of the pair of resilient board engaging elements 24 each include a plurality of board engaging notches or fingers 30 spaced such that the resilient board engaging elements 24 can engage a plurality of thicknesses of the soffit board 12. As shown in FIG. 2, each of the notches or fingers 30 may include a top surface 31 have a plane P2 that is parallel with a plane P1 of the vent strip 20. Each of the top surfaces 31 of the notches or fingers 30 are separated from the vent strip 20 by a distance D, which is approximately equal to the thickness of a certain type (thickness) of soffit board 12. This distance D is set such that top surfaces 31 are spaced to abut a board top surface 35 (shown in FIGS. 4 and 5) of the soffit board 12.

For the purposes of this invention, the term "parallel" is not intended to indicate geometric precision, but is hereby defined to include any generally parallel orientation or functionally equivalent arrangement or orientation that those skilled in the art would use to facilitate the functionality of the invention, as described herein.

For purposes of this application, the term "notch" is hereby defined to include any form of recess, engaging shape, or similar feature that may engage the soffit board 12 as described. The term "finger" is defined to include any form of finger or protrusion that functions to engage the soffit board 12 in a manner consistent with the present disclosure, and any similar or equivalent construction known to those skilled in the art.

In the embodiment of FIGS. 1 and 2, there are four board engaging notches or fingers 30, although this obviously may vary based upon the needs of the user as perceived by the manufacturer of the vent strip 20. In one embodiment, the first is a first board engaging recess 32 adapted to engage boards of ¼" thickness. A second board engaging recess 34 is adapted to engage boards of ⅜" and 5/16" thickness. A third board engaging recess 36 is adapted to engage boards of 7/16" and ½". A fourth board engaging recess 38 may be adapted to engage boards of ⅝". Although the measurements are used in this embodiment, the board engaging recesses 30 can be spaced to fit any desired board thickness.

Figure 3:
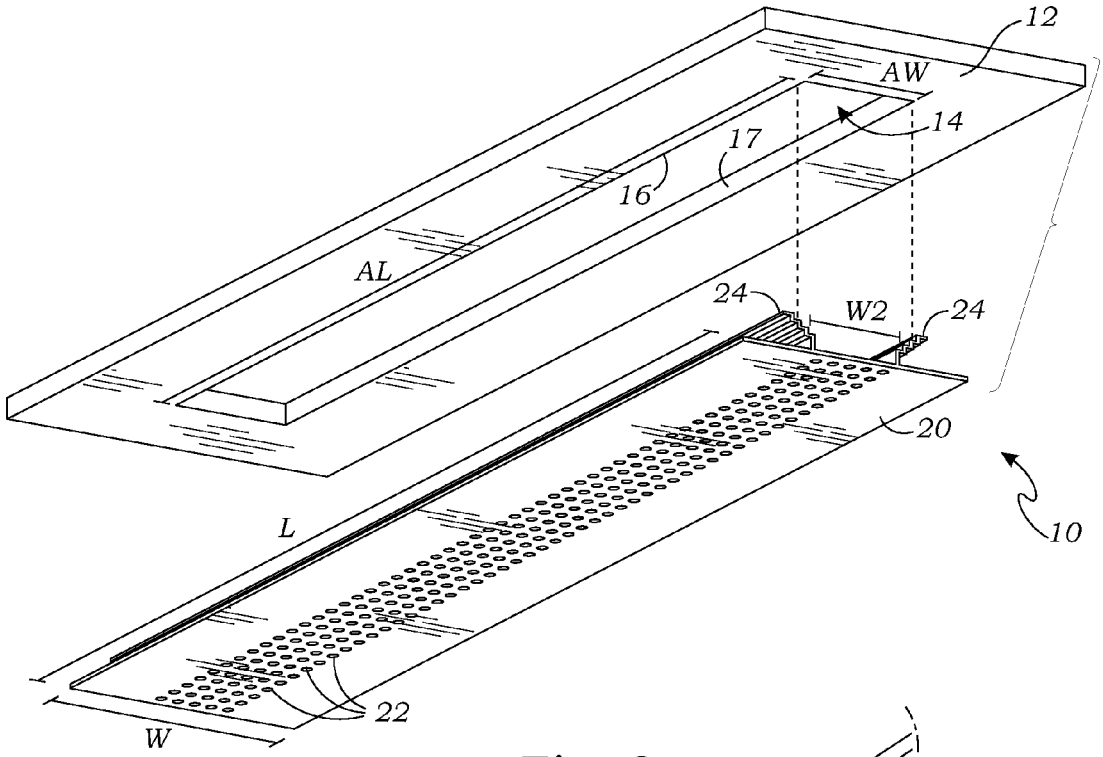
FIG. 3 is an exploded perspective view of the vent strip of FIG. 1 adjacent a soffit board, which together form a soffit assembly.

FIG. 3 is an exploded perspective view of the vent strip 20 of FIG. 1 adjacent the soffit board 12, which together form the soffit assembly 10. As illustrated in FIG. 3, the soffit board 12 is cut to form an aperture 14 having an aperture length AL and aperture width AW. The aperture length AL is cut to approximately equal length L of the vent strip 20, and the aperture width AW is approximately equal to (preferably slightly bigger than) the second width W2 between the pair of board engaging elements 24, but less than the width W of the vent strip 20. Thicker soffit boards are cut with slightly larger apertures, as discussed below. This enables the pair of board engaging elements 24 to fit into and engage the aperture 14, and for the vent strip 20 to cover the aperture 14.

Figure 4:
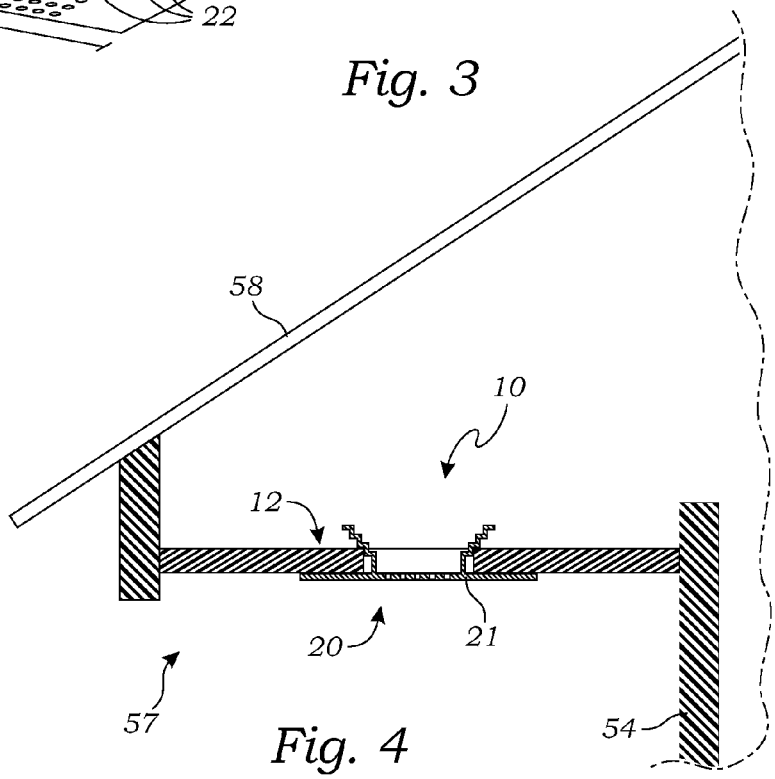
FIG. 4 is a sectional view of the vent assembly once installed under an eave of a building.

FIG. 4 is a sectional view of the soffit assembly 10 installed under the eave 57 of the roof 58 of the building 54. Once the aperture 14 has been cut, the soffit board 12 is installed under the eave 57 of the roof 58, using techniques well known in the art. The vent strip 20 is installed in the aperture 14 of the soffit board 12 as described below and as illustrated in FIGS. 5 and 6.

Figure 5:
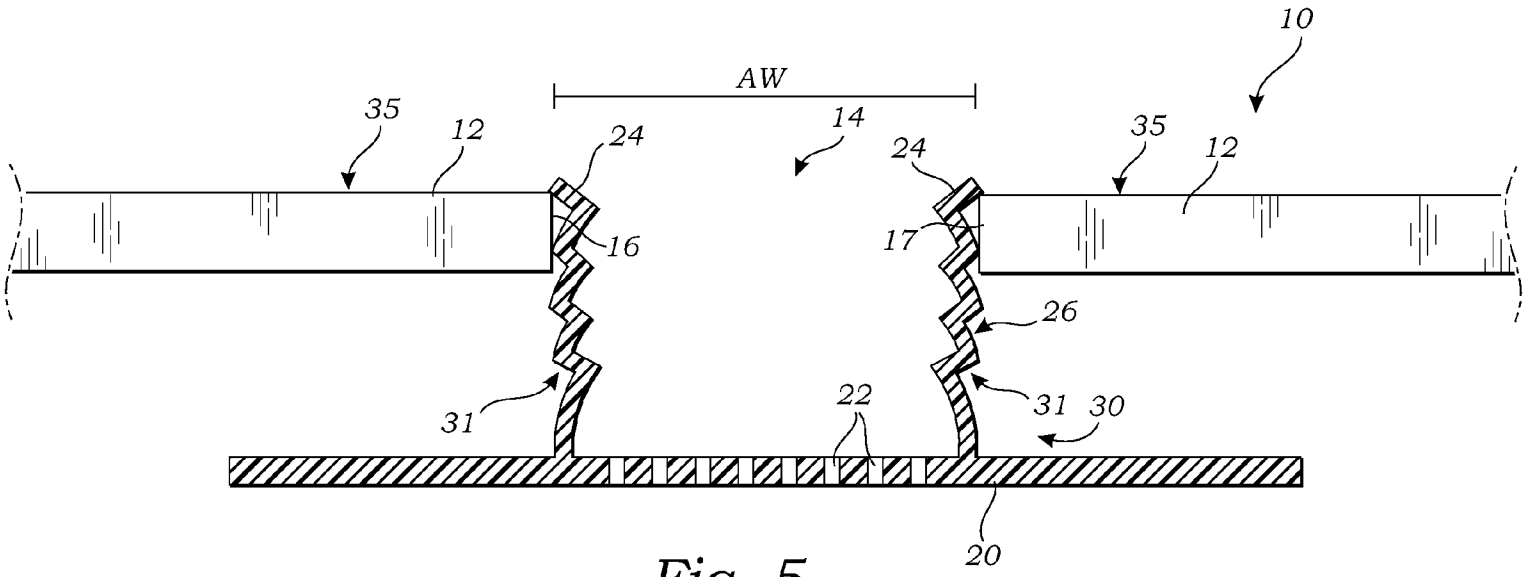
FIG. 5 is a sectional view of the soffit assembly, illustrating how the vent strip of FIG. 1 may be installed in an aperture of a soffit board.

FIG. 5 is a sectional view of the soffit assembly 10, illustrating how the vent strip 20 is installed in the aperture 14 in the soffit board 12. As shown in FIG. 5, the aperture 14 is formed between an inside edge 16 and an outside edge 17. The resilient board engaging elements 24 flex inwardly during installation to fit into and then engage the aperture 14 of the soffit board 12. Each of the resilient board engaging elements 24 either the inside or outside edges 16 or 17. In this manner, the soffit vent 20 does not itself have to be bent or bowed during installation, greatly facilitating installation.

FIG. 6 is a sectional view of the soffit assembly 10, illustrating how the vent strip 20 is adapted to cover the aperture 14 of the soffit board 12 once installed. The resilient board engaging elements 24 move between a flexed position, shown in FIG. 5, wherein the elements 24 are bent to fit through the aperture 14 between the inside and outside edges 16 and 17 during installation, and a locked position as shown in FIG. 6, wherein the elements 24 releasably engage the inside and outside edges 16 and 17, such that the resilient board engaging elements 24 run parallel to the inside and outside edges 16 and 17. Each edge 16 and 17 engages the board engaging notches or fingers 30. In the embodiment of FIG. 6, in which the soffit board 12 is thin, the edges 16 and 17 engage the first board engaging notch 32. Larger soffit boards engage different notches or fingers 30, as illustrated in FIG. 7, and as discussed below.

FIG. 7 is a sectional view of the vent strip 30 being installed between thicker soffit board 13. As illustrated in FIG. 7, the pair of board engaging elements 24 of the vent strip 30 are able to firmly engage the soffit board 13, because of the board engaging notches or fingers 30, despite the greater thickness of the soffit board 13

Figure 8:
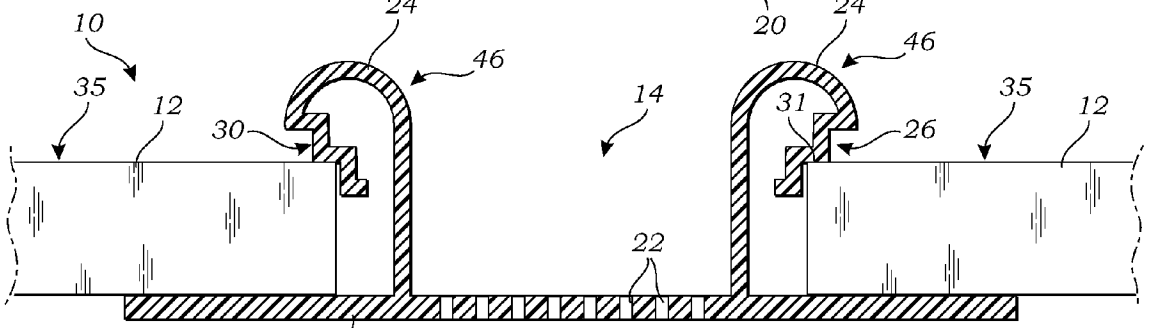
FIG. 8 is a sectional view of an alternative embodiment of the soffit assembly, illustrating an alternative form of the resilient board engaging elements.

FIG. 8 is a sectional view of an alternative embodiment of the soffit assembly 10, illustrating an alternative form of the resilient board engaging elements 24. As shown in FIG. 8, the resilient board engaging elements 24 may have a curved attachment portion 46 such that the surface 26 is located on the other side of the resilient board engaging elements 24. In other embodiments, the resilient board engaging elements 24 may have other attachment portion shapes and geometries adapted to engage the soffit board 12. Although alternate embodiments may use different shapes and geometries, the board engaging recesses 30 are always present on the surface 26 for allowing the resilient board engaging elements 24 to engage soffit boards of different thickness, and alternative constructions should be considered within the scope of the present invention.

Figure 9:
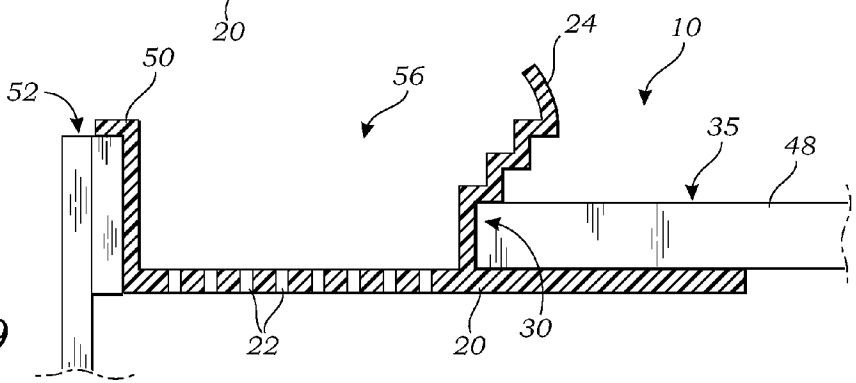
FIG. 9 is a sectional view of another alternative embodiment of the soffit assembly having only one resilient board engaging element adapted for installation between a single soffit board and a building.

FIG. 9 is a sectional view of another alternative embodiment of the soffit assembly 10 having only one resilient board engaging element 24 adapted to engage a single soffit board 48. As shown in FIG. 9, in this embodiment the soffit assembly 10 also includes a building engaging element 50 adapted to rest upon a frieze 52 of a building 54. As illustrated in this embodiment, the vent strip 20 may have only one resilient board engaging element 24 having board engaging notches or fingers 30, as described above. These types of alternative constructions should be considered within the scope of the present invention.

Figure 10:
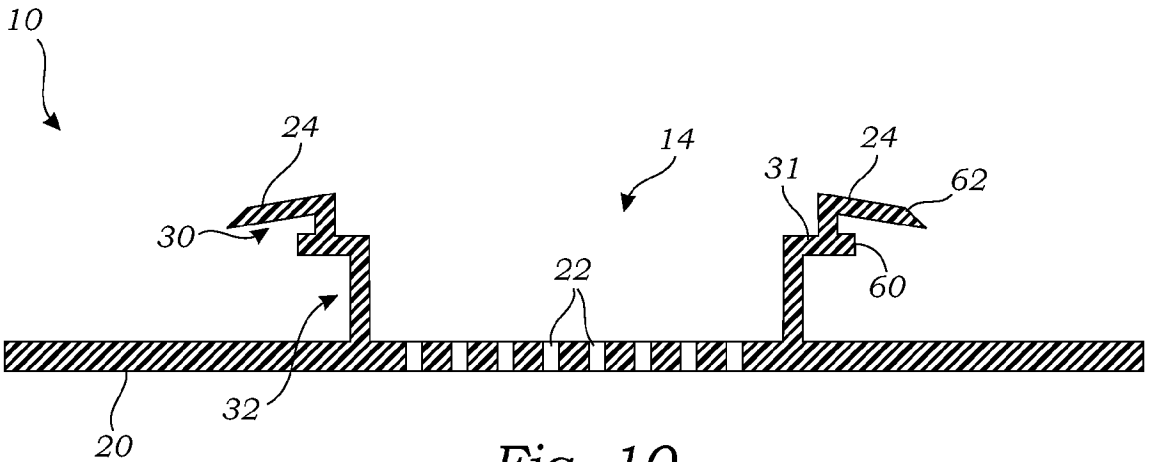
FIG. 10 is a section view of a fourth embodiment of the vent strip.
Figure 11:
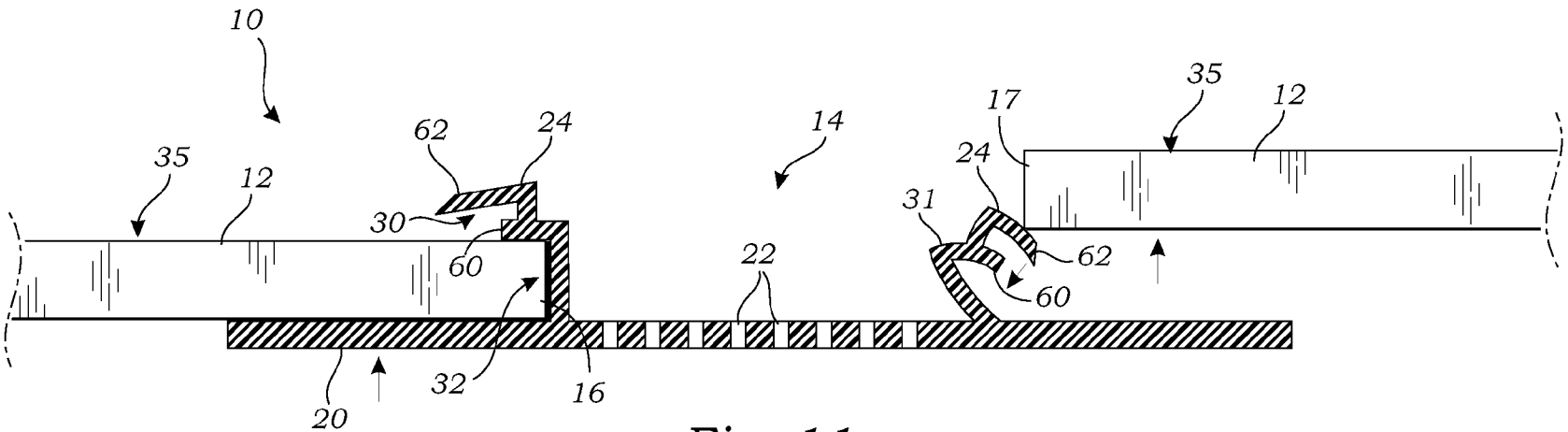
FIG. 11 is a sectional view thereof illustrating how the vent strip may be installed in a soffit board to form the soffit assembly.
Figure 12:
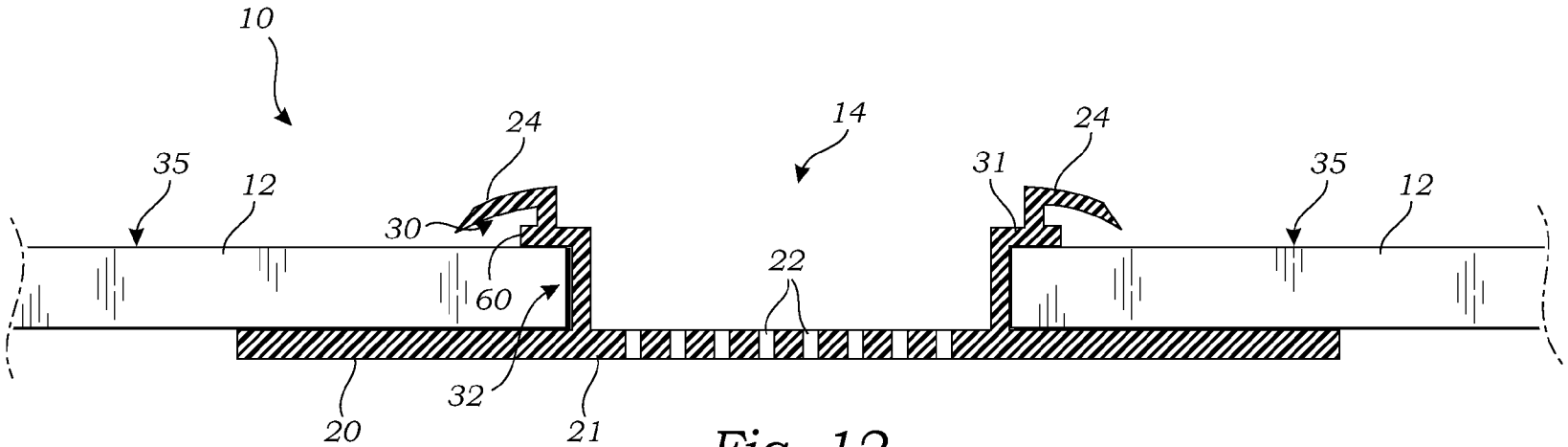
FIG. 12 is a sectional view of the soffit assembly of FIG. 9, illustrating the vent strip once it has been installed in a soffit board of a lesser thickness.

FIG. 10 is a section view of a fourth embodiment of the vent strip 20. FIG. 11 is a sectional view thereof illustrating how the vent strip 20 is installed in the soffit board 12 to form the soffit assembly 10. FIG. 12 is a sectional view of the soffit assembly 10 of FIG. 11, illustrating the vent strip 20 once it has been installed in the soffit board 12 of a lesser thickness. FIG. 13 is a sectional view of the vent strip of FIGS. 10-12, illustrating the vent strip being installed on the thicker soffit board 13 of a greater thickness.

As illustrated in FIGS. 10-13, the fourth embodiment of the vent strip 20 includes the pair of board engaging elements 24 that include, as the board engaging notches or fingers 30, first fingers 60 and second fingers 62. FIG. 11 illustrates the first and second fingers 60 and 62 flexing inwardly to fit into the aperture 14. FIG. 12 illustrates how the first fingers 60 hold the soffit board 12 of lesser thickness. FIG. 13 illustrates how the second fingers 62 hold the soffit board 13 of the greater thickness. Obviously, additional fingers and/or similar protrusions and/or recesses may be included to work with other soffit boards of even greater or lesser thickness.

The present invention also includes a method for installing the soffit assembly 10 under the eave 57 of the roof 58 on the building 54. As illustrated in FIG. 3, the aperture 14 is cut in the soffit board 12 such that the aperture length AL is roughly equal to the length L of the vent strip body 21. In this manner, the vent strip 20 does not need to be cut to fit the soffit board 12.

As illustrated in FIG. 4, the soffit board 12 is then installed under the eave 57 according to methods known in the art. The resilient board engaging elements 24 of the vent strip 20 are flexed into the flexed position and slid into the aperture 14 of the soffit board 12, as shown in FIGS. 5-6. The resilient board engaging elements 24 are pushed up into the aperture in the soffit board 12 to make contact with the correctly sized board engaging recess 30. The resilient board engaging elements 24 then lock into the locked position, releasably engaging the inside and outside edges 16 and 17 of the soffit board 12, as shown in FIG. 6.

The present invention also includes a method for installing the soffit assembly 10 as illustrated in the embodiment of FIG. 9. The building engaging element 50 is attached to the frieze 52 and the resilient board engaging element 24 is flexed into the flexed position and slid into a gap 56 between the frieze 52 and the soffit board 48. The resilient board engaging element 24 is pushed up into the gap 56 until the single soffit board 48 makes contact with the correctly sized board engaging recess 30. The resilient board engaging element 24 then locks into the locked position, releasably engaging the single soffit board 48, as shown in FIG. 9.

The terminology used in the specification provided above is hereby defined to include similar and/or equivalent terms, and/or alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction to claims to be defined in the following utility patent application.

What is claimed is:

1. A method for installing a soffit assembly, the method comprising the steps of:

providing a soffit board having an inside edge and outside edge that together define an aperture having an aperture width, the soffit board having a thickness selected from a plurality of thicknesses;

providing a vent strip comprising:

a generally rectangular vent strip body having a width that is greater than the aperture width;

a plurality of apertures through the vent strip body for enabling air circulation therethrough;

a pair of resilient board engaging elements extending upwardly and outwardly from the vent strip body, each of the pair of resilient board engaging elements being adapted to fit through the aperture of the soffit board such that each of the pair of resilient board engaging elements is adjacent one of the inside or outside edges of the soffit board; and the pair of board engaging elements comprising a plurality of board engaging notches or fingers, the plurality of board engaging notches or fingers each having a top surface with a plane that is parallel with a plane of the vent strip, such that each of the top surfaces of the plurality of notches or fingers are separated from the vent strip body by a different distance such that the plurality of notches or fingers are adapted for engaging the inside and outside edges of the soffit board, such that the vent strip may accommodate the selected thickness of the soffit board, with each of the plurality of board engaging notches or fingers being adapted to accommodate one of the plurality of thicknesses;

pressing the vent strip into the aperture of the soffit board such that the resilient board engaging elements flex to a flexed position and the resilient board engaging elements slide through the aperture of the soffit board, whereupon the plurality of resilient board engaging elements then return to a locked position wherein the plurality of resilient board engaging elements releasably engage the inside and outside edges of the aperture of the soffit board, such that the vent strip body is held in a position to cover the aperture of the soffit board.

* * * * *